US005264860A

United States Patent [19]

Quan

[11] Patent Number: 5,264,860

[45] Date of Patent: Nov. 23, 1993

[54] METAL FLARED RADIATOR WITH SEPARATE ISOLATED TRANSMIT AND RECEIVE PORTS

[75] Inventor: Clifton Quan, Arcadia, Calif.

[73] Assignee: Hughes Aircraft Company, Los Angeles, Calif.

[21] Appl. No.: 783,302

[22] Filed: Oct. 28, 1991

[51] Int. Cl.[5] ..... H01Q 13/10

[52] U.S. Cl. ..... 343/767; 343/768; 343/859

[58] Field of Search ..... 343/767, 768, 746, 820, 343/821, 822, 850, 859

[56] References Cited

U.S. PATENT DOCUMENTS 4,001,834 1/1977 Smith ..... 343/754
4,424,516 1/1984 Kruger et al. ..... 343/763
4,978,965 12/1990 Mohuchy ..... 343/795
5,023,623 6/1991 Kreinheder et al. ..... 343/767
5,027,125 6/1991 Tang ..... 342/368
5,036,335 7/1971 Jairam ..... 343/767

*Primary Examiner*—Donald T. Hajec
*Assistant Examiner*—Hoanganh Le
*Attorney, Agent, or Firm*—L. A. Alkov; W. K. Denson-Low

[57] ABSTRACT

A metal flared notch radiator with separate and isolated transmit and receive ports for an active array. A 4-port circulator is integrated into the transition of the radiator so that the integrated device has have a separate transmit port, a separate receive port, and a separate termination port to provide isolation between the transmit and receive.

11 Claims, 6 Drawing Sheets

METAL FLARED RADIATOR WITH SEPARATE ISOLATED TRANSMIT AND RECEIVE PORTS

BACKGROUND OF THE INVENTION

The present invention relates to antenna elements used in active array antenna systems.

For many active array applications the radiating element needs to have low RF losses, operate across a wide frequency band, and be inexpensive to fabricate.

A conventional flared notch radiator has only a single port for both transmit and receive. In an active array antenna each radiator is connected to a transmit/receive (T/R) module with separate transmit and receive controls. The T/R module typically contains its own duplexing network to route the transmit and receive signals. This duplexing network generally includes a 3-port circulator which adds to the cost and physical size.

In a typical active array antenna, the circulator and T/R module are packaged together in a metal housing. To reduce the cost of the metal packaging for the array, four pairs of single channel modules and circulators are assembled into the housing. This limits the shape and size of the antenna aperture that can be designed per given area because the aperture can by populated only with elements in groups of four (four elements for each four channel housing). Integrating the circulator into the radiator would eliminate this additional housing and allow more cost effective and flexible implementation of single channel modules.

Another disadvantage with the conventional approach occurs when this larger four channel assembly is attached to the cold plate. A larger cold plate is needed to mechanically support these long assemblies even though only the few active components in the modules require cooling in order to perform reliably and optimally. Integrating the circulator into the radiator would result in a shorter cold plate and module which in turn results in a shorter and lighter antenna.

The radar cross section (RCS) performance of the antenna is related to the active impedance of each individual radiating element. Placing a coaxial adapter between the radiator and the module as in the conventional active array contributes an additional mismatch and thus degrades the performance. Moving the adapter behind the circulator and then using a four port circulator would isolate the adapter and modules mismatches away from the aperture.

It is therefore an object of the present invention to provide a radiator element which integrates a signal duplexing arrangement, thereby permitting a reduction in the size and cost of the corresponding T/R module, while improving the active impedance match of the radiating element.

SUMMARY OF THE INVENTION

A flared notch radiator assembly is disclosed, having separate isolated transmit and receive ports. The assembly includes a flared notch radiating element, a transmit port and a receive port. In accordance with the invention, a signal duplexer is integrated into the assembly for coupling the radiating element to the respective transmit and receive ports. The duplexer comprises means for coupling the transmit port to the radiating element so that transmit signals provided at the transmit port are coupled to the radiating element and radiated into free space. The duplexer further includes means for coupling the radiating element to the receive port so that signals received at the radiating element are coupled to the receive port. Means are also provided for isolating the transmit port from the receive port.

In a preferred embodiment, the duplexer is a four-port circulator, with a first port connected to the transmit port, a second port connected to the balun which couples energy into and out of the flared notch radiator, a third port connected to the receive port, and a fourth port connected to a balanced load. In this manner, the transmit port is isolated from the receive port, and vice versa.

With the signal duplexer integrated into the radiator element assembly, the assembly forms a basic building block of the antenna array which is employed in an active array radar with a transmit/receive module with separate transmit and receive port, but without signal duplexer circuits such as circulators and the like. The respective transmit ports of the module and radiator assembly can be connected together, and the respective receive ports connected together as well, thereby forming a combination of the module and the integrated radiator assembly.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
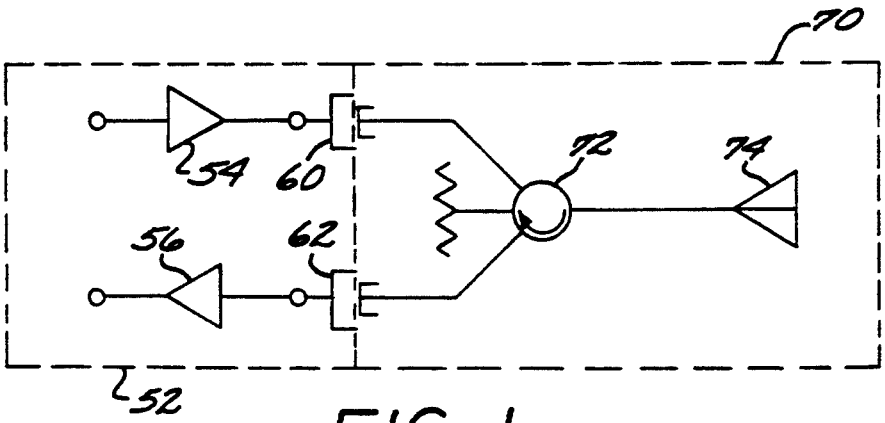
FIG. 1 is a simplified schematic diagram of the interface between a transmit/receive module and an integrated circulator/radiator assembly in accordance with the invention.

The invention is embodied in a flared notch radiator with an integrated 4-port circulator for an active array antenna. FIG. 1 illustrates the interface between a T/R module 52 and an integrated circulator/radiator assembly 60 in accordance with the invention. The T/R module 52 comprises the high power transmit amplifier 54 and the low noise receive amplifier 56, but does not include a circulator or other signal separating circuitry. A pair of connectors 60 and 62 connect the amplifiers 54 and 56 to the integrated radiator assembly 70. Radiator assembly 70 includes a circulator 72 and the radiating element 74. The ports of the circulator 72 are respectively connected to the connectors 60 and 62. A third port of the circulator 72 is connected to the radiating element 74. The circulator 72 thus provides the function of duplexing the transmit and receive signals.

Figure 2:
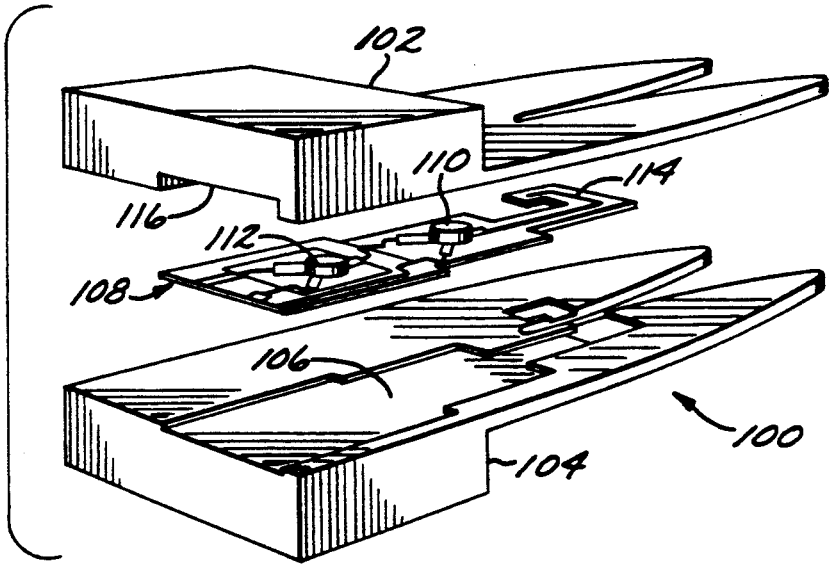
FIG. 2 is an exploded perspective view of a radiator element in accordance with the invention.

An exemplary embodiment of an integrated circulator/radiator assembly 100 in accordance with the invention is shown in FIG. 2. Here the radiator comprises a thick metal flared notch radiator element and the circulator is a 4-port microstrip circulator. The radiator comprises opposing upper and lower metal radiator members 102 and 104. Lower member 104 has a relieved channel 106 defined therein for accepting a printed circuit board 108 on which the respective three port circulators 110 and 112 are mounted. The board 108 includes a dielectric substrate 112 on which conductive traces are formed by conventional photolithographic techniques. Certain conductive traces act as transmission line conductors which connect the circulators to the interface connectors and to a balun 114 which couples energy between the flared notch radiator and the circulator 110. Upper board 102 has a relieved channel defined therein which matches the outline of the channel 106, so that the circuit board elements are not shorted by contact with the respective metal channel surfaces.

The circulator is mounted on microstrip circuitry, which transitions to the suspended substrate stripline in which the balun 114 is defined.

The stripline balun 114 enables the RF signal entering the radiator to transition from the slotline field configuration of the flared notch radiator into the TEM transmission line mode. Once in this mode the RF signal can be transformed into the same impedance and transmission line seen by the circulator. This transformer is attached directly to the circulator without the need of an outside adaptor thus completing the integration.

Figure 3:
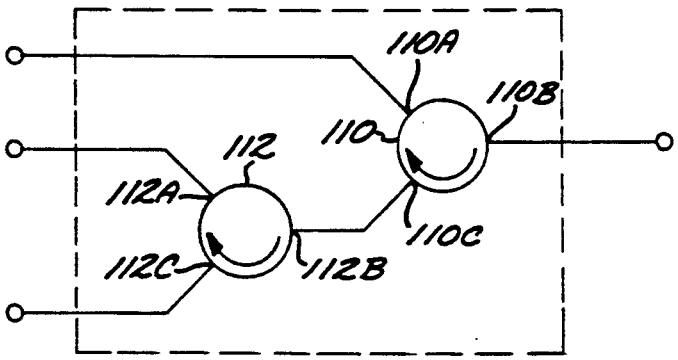
FIG. 3 is a simplified schematic diagram of one exemplary circulator arrangement employing two three port circulators which may be used in the radiator element of FIG. 2.

The 4-port circulator is realized in the embodiment of FIG. 2 by cascading two 3-port circulators 110, 112 together; alternatively, a single junction 4-port circulator can be employed. FIG. 3 is a schematic diagram illustrating the cascading of the two 3-port circulators 110 and 112 to form an effective 4-port circulator circuit. The transmit amplifier 54 is connected to port 110A of circulator 110. Port 110B is connected to the balun 114. Port 110C is connected to 112B of circulator 112. Port 112C is connected to the low noise receive amplifier 56 of the T/R module. Port 112A is connected to a balanced load.

Figure 4:
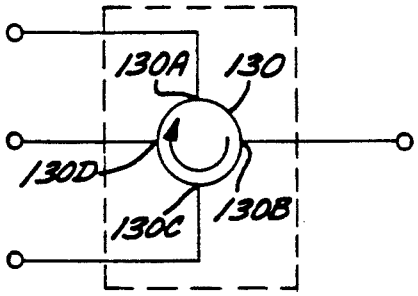
FIG. 4 is a schematic diagram of an alternate circulator arrangement which may be used in the radiator element of FIG. 2.

FIG. 4 illustrates a single junction 4-port circulator 130 which could alternatively be employed in an integrated circulator/radiator in accordance with the invention. Here, port 130A is connected to the transmit amplifier, port 130B to the radiator element, port 130C to the low noise receive amplifier of the T/R module, and port 130D is the isolation port connection to a balanced load.

This invention applies to both dielectric and thick metal flared notch radiators. This invention can also apply to radiators using balun transitions such as stripline dipole and ridge waveguides.

Figure 5A:
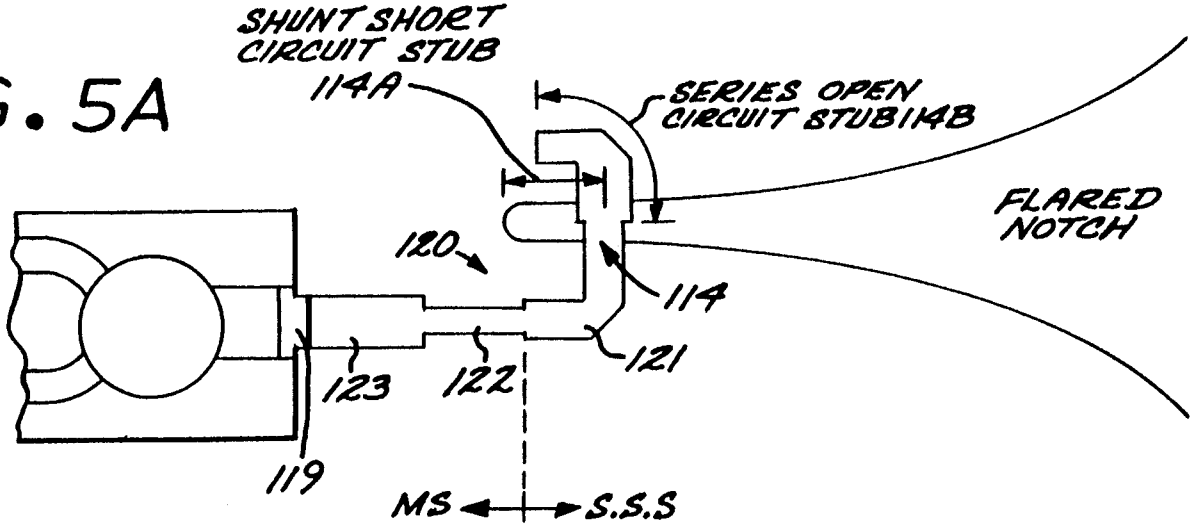
FIGS. 5A and 5B illustrate the transformer circuitry of the radiator element of FIG. 2.
Figure 5B:
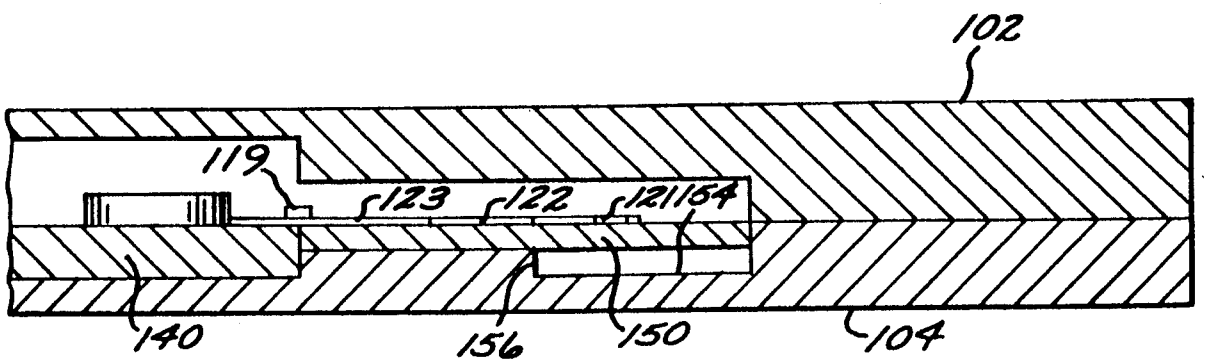
Figure 6:
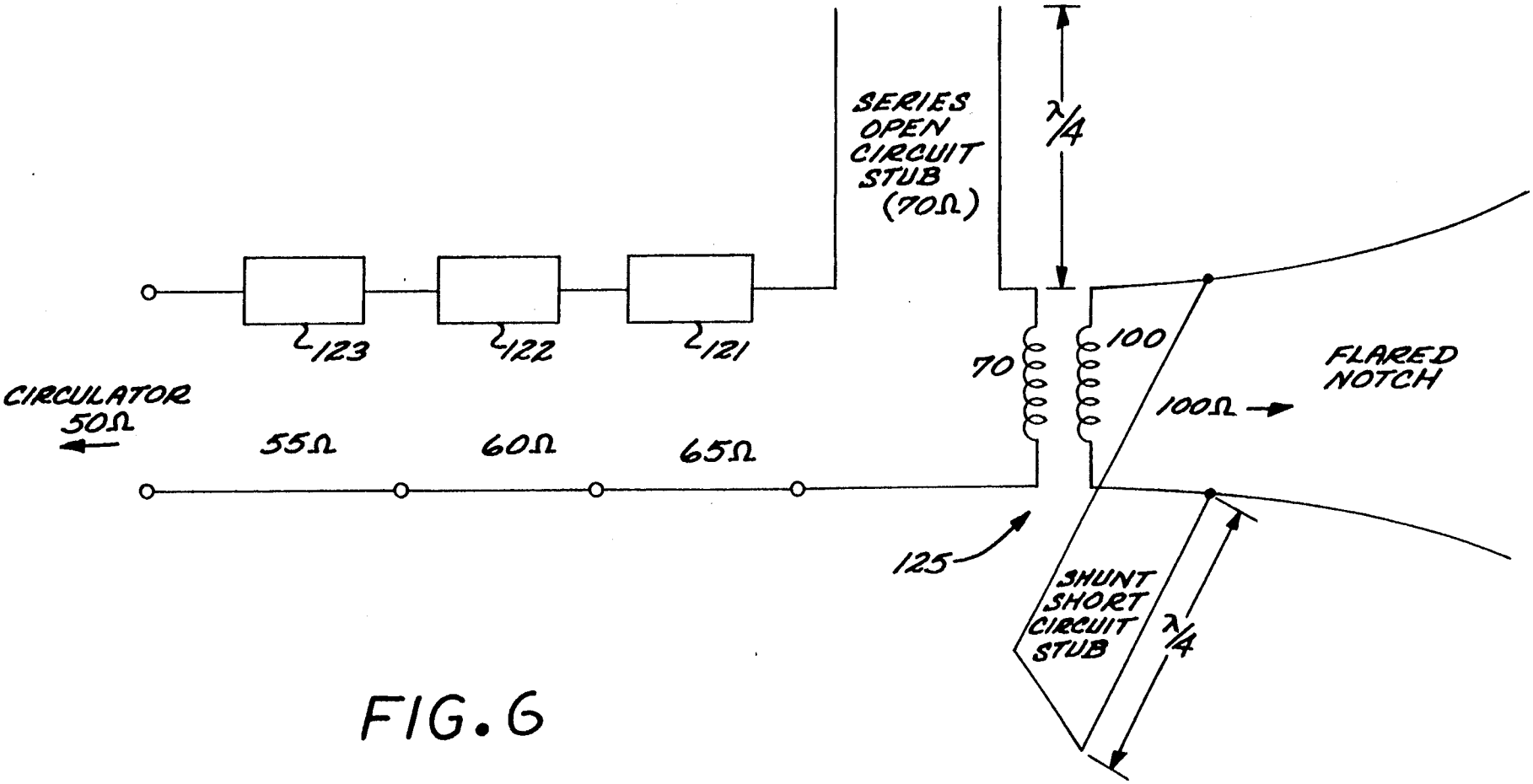
FIG. 6 is a circuit schematic of an ideal transformer circuit closely modeled by the element shown in FIGS. 5A and 5B.

As shown more clearly in FIGS. 5A, 5B and 6, the balun 114 transitioning the thick metal slotline transmission medium of the flared notch radiator to the suspended substrate stripline transmission medium of the circulator circuit comprises a shunt quarter wavelength slotline short circuited stub 114A and a series suspended substrate stripline (SSS) open circuited stub 114B. The length of the open circuited stub 114B is nominally a quarter wavelength at the center frequency of operation, but is trimmed to tune out any mismatches between the circulator, transformer and slotline. The transformer 120 comprises a three stage chebyshev impedance matching transformer. Unlike most multistage quarter wave transformers which are built in the same transmission line, a combination of two different transmission lines are used. The transformer 120 uses SSS for the first stage 121 adjacent to the balun 114, and microstrip for the remaining second and third stages 122 and 123 adjacent to the microstrip circulator. This provides the best match between the balun 114 and circulator since identical transmission lines are used. Also this combination provides the shortest possible length for the total transformer region. This allows enough room within the element to integrate the circulator. Thus, an integrated circulator/radiator in accordance with the invention can have the same length as one without the circulator.

In this embodiment, the microstrip circulator lines have a nominal characteristic impedance of 50 ohms, the third transformer stage 123 has a nominal characteristic impedance of 55 ohms, the second stage 122 a nominal characteristic impedance of 60 ohms and the first stage 121 a nominal characteristic impedance of 65 ohms. The slotline balun has a nominal characteristic impedance of 70 ohms. The circuitry models the ideal transformer 125 and transmission lines of FIG. 6.

Figure 7A:
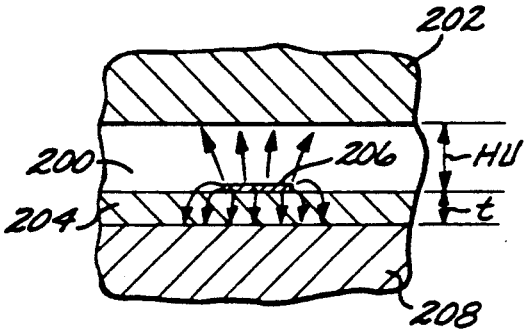
FIG. 7A illustrates the electromagnetic E-field configuration in an end view of a microstrip transmission line with a cover.

The transition from SSS to microstrip is done within the transformer itself. Because both transmission lines have similar field configurations, transitioning from SSS to microstrip involve merely eliminating the lower air gap "HL" by raising the groundplane right between the first and second stages of the transformer. FIG. 7A shows an end view of a microstrip transmission line circuit 200 including a metal cover 202. The circuit includes a center conductor trace 206 formed on a dielectric substrate 204 of thickness t, which in turn rests on a metal groundplane 208. The cover 202 is at a height H above the substrate 204 and also acts as a groundplane. The E-field configuration is illustrated in FIG. 5A for this microstrip circuit.

Figure 7B:
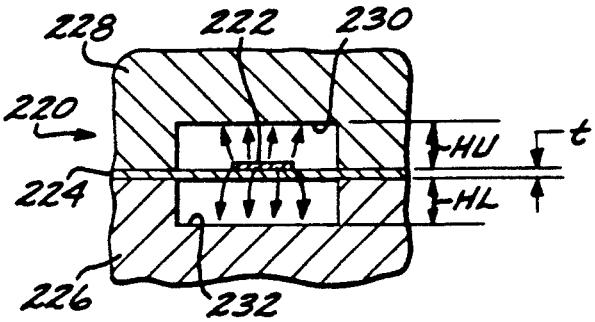
FIG. 7B illustrates the electromagnetic E-field configuration in an end view of a suspended substrate stripline.

FIG. 7B is an end view which illustrates the E-field configuration of a suspended substrate stripline (SSS) circuit 220. The circuit 220 comprises a conductive trace 222 formed on a dielectric substrate 224 which is suspended between two metallic housing members 226 and 228. The surface 230 of housing 228 is spaced from the substrate 224 by a distance HU; the surface 232 of housing 226 is spaced from the bottom of the substrate by a distance HL. The arrows indicate the E-field configuration of the circuit 220. The similarities between the field configurations of the respective types of circuits 200 and 220 are apparent.

Figure 7C:
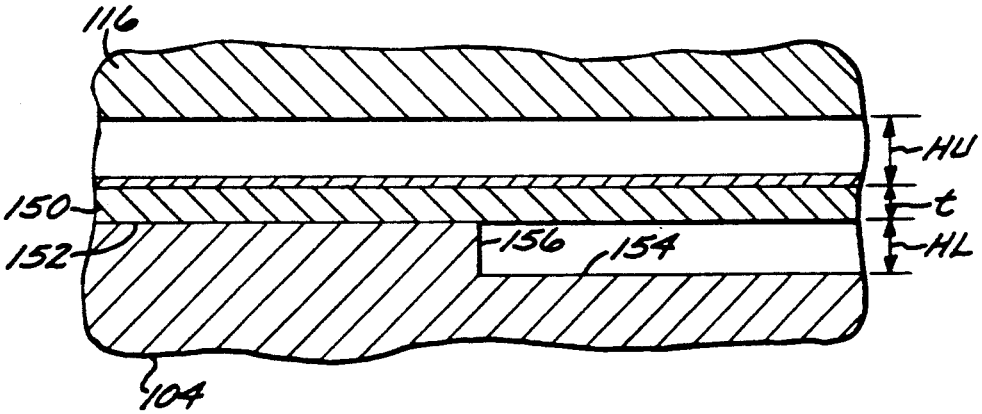
FIG. 7C illustrates in cross-section a microstrip to suspended substrate stripline transition employed in a radiator element in accordance with the invention.

FIG. 7C is a partial side cross-sectional view of the integrated radiator assembly 100 of FIG. 2, which illustrates the transition from microstrip to SSS circuitry, connecting the circulator to the balun. The transition to SSS occurs at point 156, wherein the surface 152 supporting the substrate 150 drops to surface 154, at a height HL below the lower surface of the substrate 150. Thus, the surface 152 provides the lower groundplane for the microstrip circuit, and surface 154 provides the lower groundplane for the SSS circuit.

The placement of the transition at this location (point 156) allows the minimum dimensional variation in both the center trace and ground return between the two transmission lines. Because these dimensional variations are minimized, RF discontinuities are also kept to a minimum. Both the transformer and balun are integrated on the same fiber-teflon circuit board 150. The center trace over the SSS and microstrip are located on top of the board 150. The ground return from the SSS, slotline and microstrip comprise the metal radiator housing surfaces 154 and 152 in contact with the microstrip groundplane located on the bottom of the circuit board and circulator ferrite substrate. The connection of the microstrip between the transformer and circulator is made by either soldering or welding a gold ribbon 119 across the interface between the two substrates. Thus, in this embodiment the circulator assembly is formed on a separate substrate 140 from the transformer circuitry, which has its own substrate 150. This technique can apply to integrating a 3-port circulator as well as a 4-port circulator into the radiator to create the complete assembly 100.

Each of the single junction 3-port circulators comprises a biasing permanent magnet, a steel carrier to complete the magnetic circuit and a ferrite substrate with the microstrip circuit and groundplane printed on it. The 3-port circuit comprises a single junction disk resonator of either circular or triangular shape to which the three outputs are attached with matching networks. Signal routing by the circulator is achieved by biasing a magnetic field through ferrite substrates from the magnet to the carrier. These circulators are commercially available. The radiator housing is designed to enclose the circulator assembly completely as one integral package.

To reduce the depth of the circulator section, the two junction assembly can be replaced by a single junction 4-port circulator. This component is similar to the 3-port construction except that the resonator used in the junction is a ring instead of a disk and having the four ports attached to it with appropriate matching networks to ensure good bandwidth performance.

The inclusion of the 4-port circulator into the flared notch allows the radiator assembly 100 to have separate transmit and receive ports 160 and 162 as shown in FIG. 6. An RF signal (indicated by line 166) transmitted from the T/R module 52 first enters the transmit port 160 of the unit. The 4-port circulator 164 (comprising the cascaded two 3-port circulators 110 and 112 of FIG. 2) routes the signal directly to the slotline flared notch and radiates into free space. Negligible amounts (if any) of this transmitted signal will directly leak to the receive port 162 because the circulator 164 will isolate that reverse path. Likewise the circulator 164 will accept the RF signal entering the flared notch (indicated by line 168) and route it directly to the receive port 162 and isolate it from directly entering the transmit port 160. The inclusion of a 3-port circulator (instead of a 4-port circulator) into the radiator can perform the same functions.

The inclusion of the 4-port circulator into the flared notch allows the separated transmit and receive ports to be isolated from each other as illustrated in FIG. 7. The RF signal entering the receive port 162 and indicated by line 170 is routed by the 4-port circulator 164 directly to the isolated port which is terminated with a matched load 174. Negligible amounts, if any, of this signal will directly leak to the transmit port 160 from the receive port 162. Thus, the transmit and receive ports are isolated from each other from either direction. The inclusion of a 3-port circulator into the flared notch only isolated signals from the transmit port 160 from directly entering the receive port 162 but not in the reverse direction.

Figure 8:
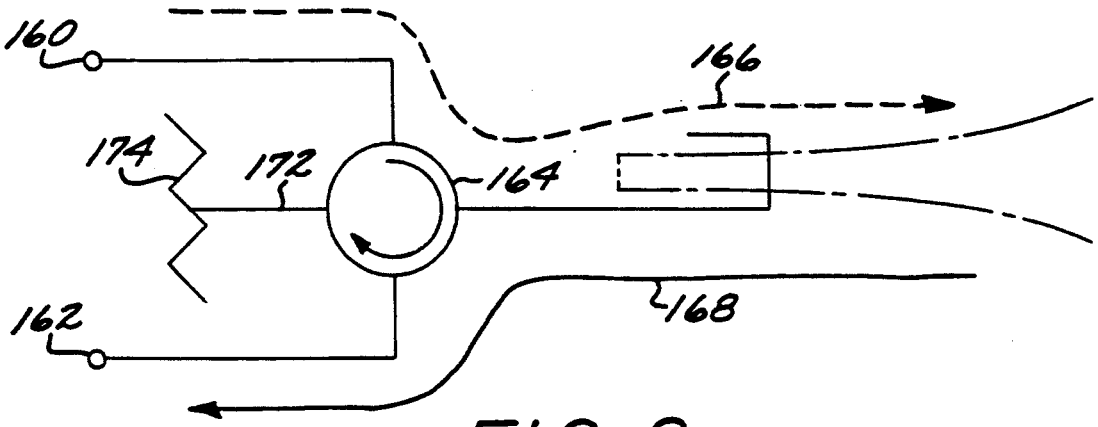
FIGS. 8–13 illustrate the various signal paths for embodiments of a radiating element in accordance with the invention.
Figure 9:
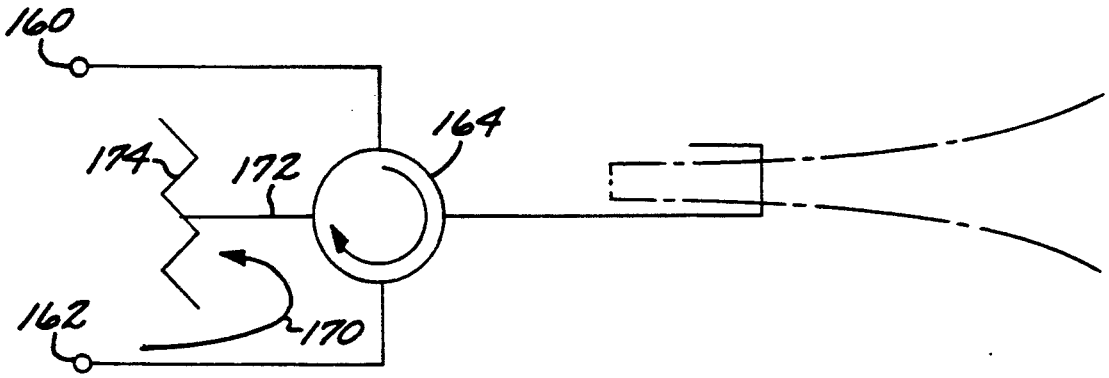

The isolation property offered by this 4-port circulator in this unit are advantageous for active array antennas as illustrated in FIG. 8. The active impedance of a typical phased array antenna changes as a function of frequency and scan angle. Should the receive port of the module have high VSWR, it is conceivable with a 3-port circulator that some of the power transmitted from the module can be reflected back from the radiator to the transmit port by bouncing off the receive port, as shown in FIG. 9. This would cause VSWR interaction in the form of load-pull and thus degrade the performance of the high power amplifiers of the module. This possibility has been eliminated by the presence of the 4-port circulator 164 because the reflected transmitted signal (indicated by line 176 in FIG. 8) would be dumped into the matched load 174 terminating the isolation port 172. Thus, the transmit port 160 is isolated from antenna aperture mismatches and the module receive port 162 with interconnect. This is limited only by the circulator frequency band of operation and the performance of the isolation termination.

Figure 10:
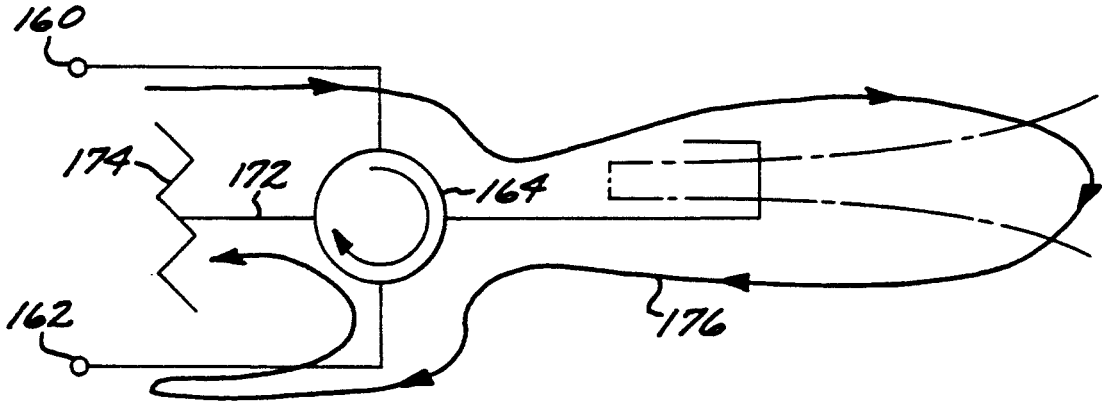
Figure 11:
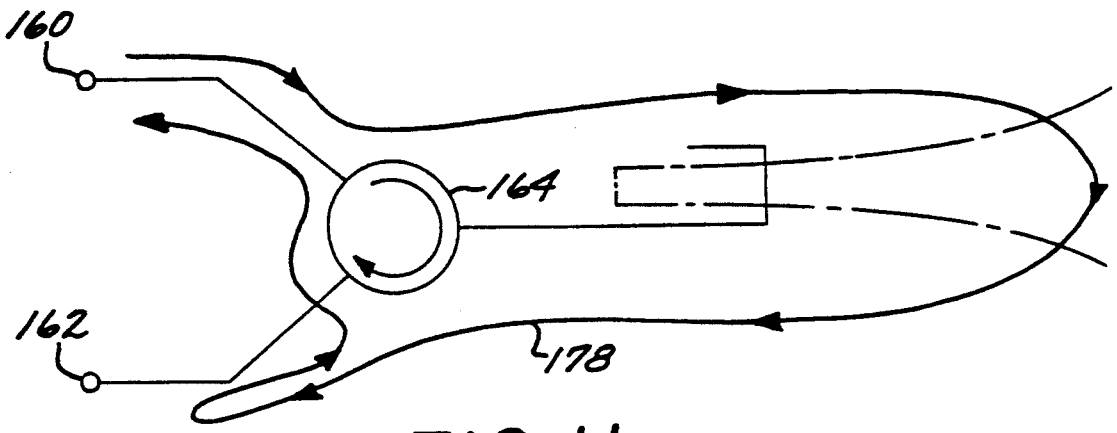
Figure 12:
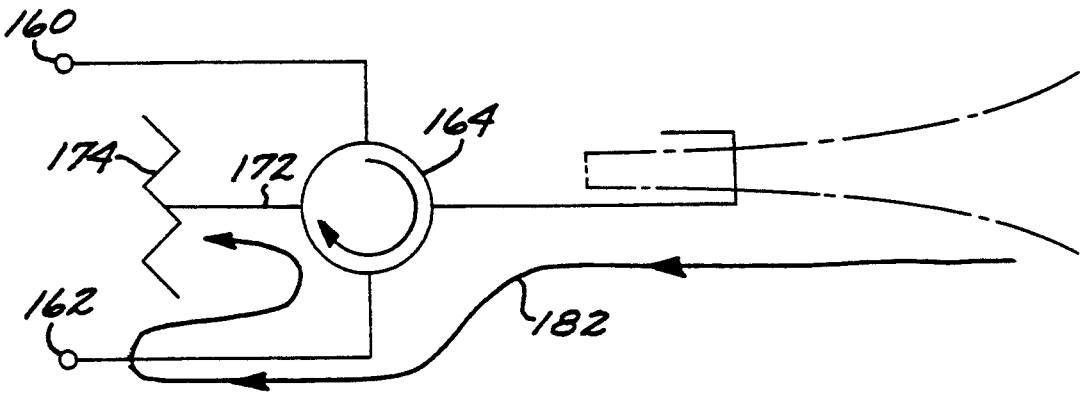
Figure 13:
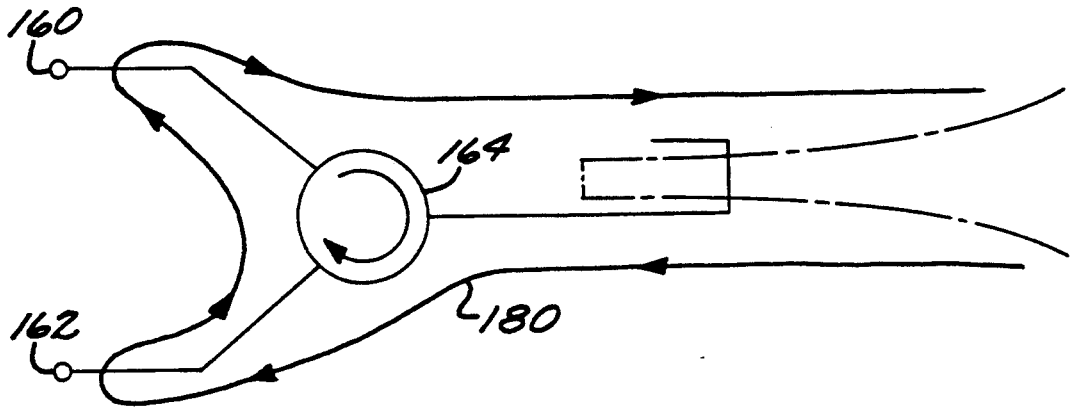

The inclusion of the 4-port circulator into the radiator provides better control of the impedance looking into the flared notch (FIGS. 10 and 11). Should both the transmit and receive ports of the module have high VSWR, it is conceivable with a 3-port circulator that a significant amount of the RF receive signal from the flared notch will be reflected back out into space, as indicated by line 180 in FIG. 11. This reflected signal contributes to the overall scattering by the antenna and thus degrades its RCS response. This possibility is eliminated when the 4-port circulator 164 is used (FIG. 10) because the reflected energy is then dumped into the matched load 174 terminating the isolation port 172. The circulator 164 has isolated the flared notch from the mismatches seen at the module ports including adapters. Thus, the impedance looking into the radiator beyond the circulator is determined by the matched isolation load. This is limited only by the performance of the 4-port circulator and load.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In an active array antenna, an integrated flared radiator assembly with separate isolated transmit and receive ports, comprising:

a flared notch radiating element;

a transmit port;

a receive port; and signal duplexer for coupling said radiating element to said respective transmit and receive ports, said duplexer comprising means for coupling said transmit port to said radiating element so that transmit signals provided at said transmit port are coupled to said radiating element and radiated into free space, means for coupling said radiating element to said receive port so that signals received at said radiating element are coupled to said receive port, and means for isolating said transmit port from said receive port and wherein said signal duplexer further comprises a balun element for coupling electromagnetic energy into and out of said radiating element and a circulator means integrated into said radiator assembly and comprising a first port connected to said transmit port, a second port connected to said balun, a third port connected to said receive port and a fourth port connected to a load and wherein said radiator element comprises a thick metal flared notch radiator comprising upper and lower thick metal members which define a flared notch, and said balun is disposed at said notch so that electromagnetic energy is prevented from passing between said transmit and receive ports.

2. The radiator assembly of claim 1 wherein said balun is defined on a suspended substrate stripline, said stripline suspended between said first and second metal members.

3. The radiator assembly of claim 2 wherein said circulator is mounted on a microstrip circuit comprising microstrip transmission lines for respectively coupling said first port to said transmit port, said third port to said receive port and said third port to said balun.

4. The radiator assembly of claim 3 further comprising an impedance transforming circuit for transforming between said suspended substrate stripline to said microstrip circuit.

5. The radiator assembly of claim 4 wherein said transforming circuit comprises a shunt quarter wavelength slotline short circuited stub and a series suspended substrate stripline open circuited stub.

6. The radiator assembly of claim 4 wherein said transforming circuit comprises a three stage chebyshev impedance matching transformer.

7. An integrated flared notch radiator and circulator assembly having separate isolated transmit and receive ports for an active array antenna, comprising:

a flared notch radiator element, comprising fist and second conductive members defining a radiator notch;

a transmit port;

a receive port;

a balun disposed at said notch for coupling electromagnetic energy into and out of said radiator element;

a circulator circuit integrated with said first and second conductive members, said circuit comprising means for connecting said transmit port to said balun, means for connecting said balun to said receive port and means for isolating said transmit port form said receive port so that electromagnetic energy is prevented from passing between said transmit and receive ports, and wherein said flared notch radiator element is a thick metal flared notch radiator element defined by first and second thick metal radiator elements which sandwich a circuit board carrying said balun and said circulator circuit.

8. The assembly of claim 7 wherein said circulator circuit comprises a four-port circulator, wherein a first port is connected to said transmit port, a second port is connected to said balun, a third port is connected to said receive port, and a fourth port is connected to a balanced load.

9. The assembly of claim 7 wherein said balun is formed by a suspended substrate slotline circuit comprising said circuit board.

10. The assembly of claim 9 wherein said circulator is connected to microstrip conductor traces formed on said substrate, and wherein said balun further comprises an impedance matching circuit for coupling said circulator to said balun to transition from said microstrip circuit to said suspended substrate slotline circuit.

11. The assembly of claim 10 wherein said impedance matching circuit comprises a three stage chebyshev transformer.

* * * * *